US007972556B2

(12) United States Patent
Araseki et al.

(10) Patent No.: US 7,972,556 B2
(45) Date of Patent: Jul. 5, 2011

(54) ELECTROMAGNETIC AGITATOR

(75) Inventors: Hideo Araseki, Chiba (JP); Hirofumi Kasahara, Tokyo (JP)

(73) Assignee: Central Research Institute of Electric Power Industry, Tokyo (JP)

( * ) Notice: Subject to any disclaimer, the term of this patent is extended or adjusted under 35 U.S.C. 154(b) by 503 days.

(21) Appl. No.: 11/997,363

(22) PCT Filed: Aug. 9, 2006

(86) PCT No.: PCT/JP2006/315762

§ 371 (c)(1),
(2), (4) Date: Jan. 30, 2008

(87) PCT Pub. No.: WO2007/018241

PCT Pub. Date: Feb. 15, 2007

(65) Prior Publication Data

US 2010/0148411 A1 Jun. 17, 2010

(51) Int. Cl.
*C21C 7/00* (2006.01)

(52) U.S. Cl. ..... 266/234; 266/233

(58) Field of Classification Search ..... 266/234, 266/233, 200, 242

See application file for complete search history.

(56) References Cited

U.S. PATENT DOCUMENTS 5,462,572 A * 10/1995 Tallback ..... 75/10.16
2010/0044934 A1* 2/2010 Taniguchi et al. ..... 266/234

FOREIGN PATENT DOCUMENTS

| | | |
|---|---|---|
| JP | 57-38200 | 3/1982 |
| JP | 58-022888 | 2/1983 |
| JP | 2000-152600 | 5/2000 |
| JP | 2003-220323 | 8/2003 |

* cited by examiner

*Primary Examiner* — Scott Kastler

(74) *Attorney, Agent, or Firm* — Notaro, Michalos & Zaccaria P.C.

(57) ABSTRACT

An electromagnetic stirring apparatus includes a vessel (2) for containing an electroconductive material in a molten state, such as a molten metal (1); an axially traveling magnetic field generating coil (3) for generating magnetic line of force (15) in an axial direction of the vessel (2) towards the molten metal (1) contained in the vessel (2) from an outside of the vessel (2); and a strip-shaped magnetic plate (4) disposed between the coil (3) and the vessel (2). Portions (11) where an axial electromagnetic force is generated in the molten metal contained in the vessel by the coil (3), and portions (10) into which a magnetic field is prevented by the magnetic plate (4) from locally entering, are formed in the vessel (2), whereby a circumferential pressure gradient is generated. Only with the axially traveling magnetic field generating coil (3), streams formed by convolution of axial motion and rotary motion are generated in the molten metal (1) in accordance with the axial electromagnetic force and the circumferential pressure gradient, thereby to perform stirring of the molten metal (1).

7 Claims, 6 Drawing Sheets

ELECTROMAGNETIC AGITATOR

TECHNICAL FIELD

The present invention relates to an electromagnetic stirring apparatus for an electroconductive material in a molten state, such as molten metal. More specifically, the invention relates to an electromagnetic stirring apparatus for performing stirring contactlessly of an electroconductive material in a molten state, such as molten metal, by utilizing electromagnetic force.

BACKGROUND ART

In a metal purifying process, additives have to be mixed with metal as uniformly as possible for the purpose of achieving significant improvements in intensity and quality, and molten metal has to be sufficiently stirred to achieve the purpose. Stirring of such molten metal is necessary also in various other fields of metal manufacture, such as manufacture of metallic particle dispersed composite materials, manufacture of ultra-clean metal materials by exhaustive separation of in-metal inclusions, and manufacture of high purity metal materials by utilizing a high level refining function, as well as manufacture of alloy, in particular, in a case of uniformly mixing alloy components having significantly different densities.

Hitherto, as techniques for performing contactless, intensive, and uniform stirring of molten metal, various types of electromagnetic stirring apparatuses using electromagnetic force have been proposed. It is known that, in the stirring of molten metal, it is effective to perform not only circumferential stirring but also vertical stirring. However, electromagnetic stirring using rotationally (circumferentially) traveling magnetic fields has drawbacks. When this technique is applied to stirring of molten metal in a vessel, a liquid surface is largely distorted due to rotation, so that a large amount of power cannot be input. In addition, only with rotary motion, the molten metal exhibits behavior like rigid body rotation, so that mixing of the molten metal is insufficient. Further, from the experiment results, it has been disclosed that, in comparison to the rotary motion of the molten metal, the motion in an axial direction (vertical direction) has a large resistance, so that sufficient effects cannot be obtained only from rotary motion by a rotary magnetic field.

In recent years, electromagnetic stirring apparatuses have been proposed in which the electromagnetic force is utilized to thereby simultaneously perform not only vertical stirring but also circumferential stirring. As a stirring apparatus simultaneously performing vertical and circumferential stirring by using electromagnetic force, there has been proposed a stirring apparatus of a type (Patent Document 1) of using two types coils, namely three-phase alternating current coils. The coils respectively generate a vertically traveling magnetic field and circumferentially traveling magnetic field, and are disposed exteriorly of a vessel, in which the induction effect is utilized to generate vertical and circumferential electromagnetic force, thereby to simultaneously perform vertical and circumferential stirring.

In addition, there has been an induction-type electromagnetic driving device (Patent Document 2). The driving device has a configuration in which a coil ("rotary coil", hereinafter) for providing a rotary magnetic field to molten metal in a vessel is diagonally disposed in a spiral form about an iron core with respect to the axis of the vessel, a distortional magnetic field is applied by energization of the three-phase alternating current, thereby to provide an axially traveling magnetic field (traveling magnetic field) simultaneously with the rotary magnetic field.

[Patent Document 1] Japanese Patent Application Laid-Open No. 2003-220323

[Patent Document 2] Japanese Patent Application Laid-Open No. 2000-152600

DISCLOSURE OF THE INVENTION

Problems to be Solved by the Invention

However, in the electromagnetic stirring apparatus disclosed in Patent Document 1, the respective three-phase alternating current coils for generating the vertically traveling magnetic field and the circumferential traveling magnetic field are overlaid on the outside of the vessel. As such, the coil volume is increased, thereby to increase the size of the apparatus and also to making the apparatus expensive because of the provision of the two types of coils.

In the case of the electromagnetic stirring apparatus disclosed in Patent Document 2, since the coil for providing the rotary magnetic field is disposed in the spiral manner, the current flowing to the molten metal does not form a loop closed in the apparatus. Thus, there is generated electrical energy not contributing to generation of driving force, whereby the stirring capacity is prone to be low.

An object of the present invention is to provide an electromagnetic stirring apparatus capable of generating streams working for simultaneously performing axial and circumferential stirring only with an axially traveling magnetic field generating coil.

Means for Solving the Problems

In order to achieve the object, an electromagnetic stirring apparatus in accordance with the present invention includes a vessel for containing an electroconductive material in a molten state; an axially traveling magnetic field generating coil for generating magnetic line of force in an axial direction of the vessel towards the electroconductive material in a molten state contained in the vessel from an outside of the vessel; and a strip-shaped magnetic plate disposed between the coil and the vessel. The magnetic plate may be disposed to diagonally extend across the coil or may be disposed along an axial direction of the coil.

According to the electromagnetic stirring apparatus in accordance with the present invention, in the vicinity of a circumferential wall of the vessel, an axially traveling magnetic field is formed in the vessel by using the axially traveling magnetic field generating coil. In addition, an axial electromagnetic force is formed by electromagnetic induction between a current flowing through the electroconductive material in a molten state, such as molten metal. In accordance with the axial electromagnetic force, axial motion is imparted to the molten metal in the vicinity of the circumferential wall. Concurrently, in a portion where the magnetic plates are provided, the magnetic field is prevented by the influence of the magnetic plates from locally entering into the molten metal, so that the electromagnetic force is not generated. Accordingly, by disposition of the magnetic plates, portions/areas into which the magnetic field does not enter and portions/areas into which the magnetic field enters are formed in the vicinity of the circumferential wall of the vessel. Thereby, a pressure gradient including a circumferential component resulting from the electromagnetic force is generated therebetween, whereby a stream different from the stream of the molten metal resulting from the axial electromagnetic force, that is, a stream flowing along the pressure gradient including the circumferential component, is provided to the molten metal. Thereby, streams formed by convolution of the axial motion resulting from the axial electromagnetic force and the rotary motion resulting from the pressure gradient are generated in the molten metal in the vicinity of the circumferential wall of the vessel. In this manner, the molten metal is simultaneously stirred along the axial and circumferential directions.

For example, in a case where the magnetic plates are each diagonally disposed between the coil and the vessel, portions into which the magnetic field does not enter because of the magnetic plates are diagonally formed. Thereby, the circumferential pressure gradient is formed, and circumferential rotation is generated in the molten metal. As a consequence, spiral streams formed by convolution of the axial motion resulting from the axial electromagnetic force and the rotary motion resulting from the circumferential pressure gradient are generated in the molten metal.

Alternatively, in a case where the magnetic plates are each vertically (axially) disposed between the coil and the vessel, portions/areas into which the magnetic field does not enter because of the magnetic plates and portions/areas into which the magnetic field enters are alternately disposed along the circumferential direction. In this case, a stream of the molten metal in the direction of the electromagnetic force is generated by the electromagnetic force in areas not influenced by the magnetic plates, that is, the areas into which the magnetic field enters. However, in the areas influenced by the magnetic plates, a reverse axial stream is generated since a pressure difference occurs between upper and lower portions of the molten metal in the vessel as a result of the stream having the direction of the axially acting electromagnetic force. Thereby, in the molten metal, there are generated a convective flow that flows down or upward along the circumferential wall of the vessel to the center of the vessel, and a convective flow involving circumferential traveling along the circumferential wall of the vessel. Consequently, the molten metal is simultaneously stirred in axial and circumferential directions.

Effects of the Invention

According to the electromagnetic stirring apparatus in accordance with the present invention, an axial electromagnetic force is formed in the vessel by using the axially traveling magnetic field generating coil. Concurrently, by the magnetic plates disposed between the coil and the vessel, portions/areas into which the magnetic field enters and portions/areas into which the magnetic field does not enter are formed in the vessel, and a pressure gradient is generated therebetween. As such, a stream of the molten metal resulting from the axial electromagnetic force and a stream different from the axial stream, that is, a stream flowing along the pressure gradient including the circumferential component, are provided to the molten metal. Thereby, streams formed by convolution of the axial motion resulting from the axial electromagnetic force and the rotary motion resulting from the pressure gradient are generated in the molten metal in the vicinity of the circumferential wall of the vessel. In this manner, the molten metal is simultaneously stirred along the axial and circumferential directions.

The flow of the molten metal can be controlled in various ways in accordance with the directions and positions of the magnetic plates. For example, in the case where the magnetic plates are each diagonally disposed, spiral streams formed by convolution of the axial motion resulting from the axial electromagnetic force and the rotary motion resulting from the circumferential pressure gradient are generated in the molten metal, thereby to be able to perform stirring of the molten metal.

Alternatively, in the case where the magnetic plates are each vertically disposed, a convective flow directed downward or upward along the circumferential wall of the vessel to the center of the vessel and a convective flow involving circumferential traveling along the circumferential wall of the vessel are simultaneously generated in the molten metal. Thereby, while stirring is being performed by using a convective flow directed overall to the center of the vessel, stirring can be performed in the vicinity of the circumferential wall of the vessel by using a convective flow locally traveling along the circumferential wall.

Further, the circumferential pressure gradient is formed in the manner that an axially traveling magnetic field for imparting the axial motion causing resistance higher than the circumferential rotary motion in traveling of the molten metal is formed and a part of the formed field is lost, so that the rotary motion is obtained. Therefore, a rotating magnetic field generating coil for obtaining the rotating magnetic field is not necessary. Consequently, simultaneous stirring along the axial and circumferential directions can be accomplished in the configuration that is compact and that includes only the axially traveling magnetic field generating coils and a reduced number of component parts. Further, since the circumferential traveling component (rotation) is generated by primarily utilizing the axial traveling component effective for stirring, the configuration has a high stirring capacity.

BRIEF DESCRIPTION OF THE DRAWINGS

FIG. 2 is a view showing one embodiment of an axially traveling magnetic field generating coil, in which FIG. 2(A) is an expanded view, FIG. 2(B) is a transverse cross sectional view of slot and coil portions of an iron core, and FIG. 2(C) is an explanatory view showing the relationship between an electromagnetic force and a pressure gradient.

FIG. 3 is a three-phase alternating current coil working as an electromagnetic force generator, in which FIG. 3(A) is a cross sectional view of the three-phase alternating current coil, FIG. 3(B) is a view showing a phase difference occurring in the three-phase alternating current coil, and FIG. 3(C) is a view showing an electrical arrangement of the three-phase alternating current coil.

EXPLANATION OF REFERENCE NUMERALS

Figure 1:
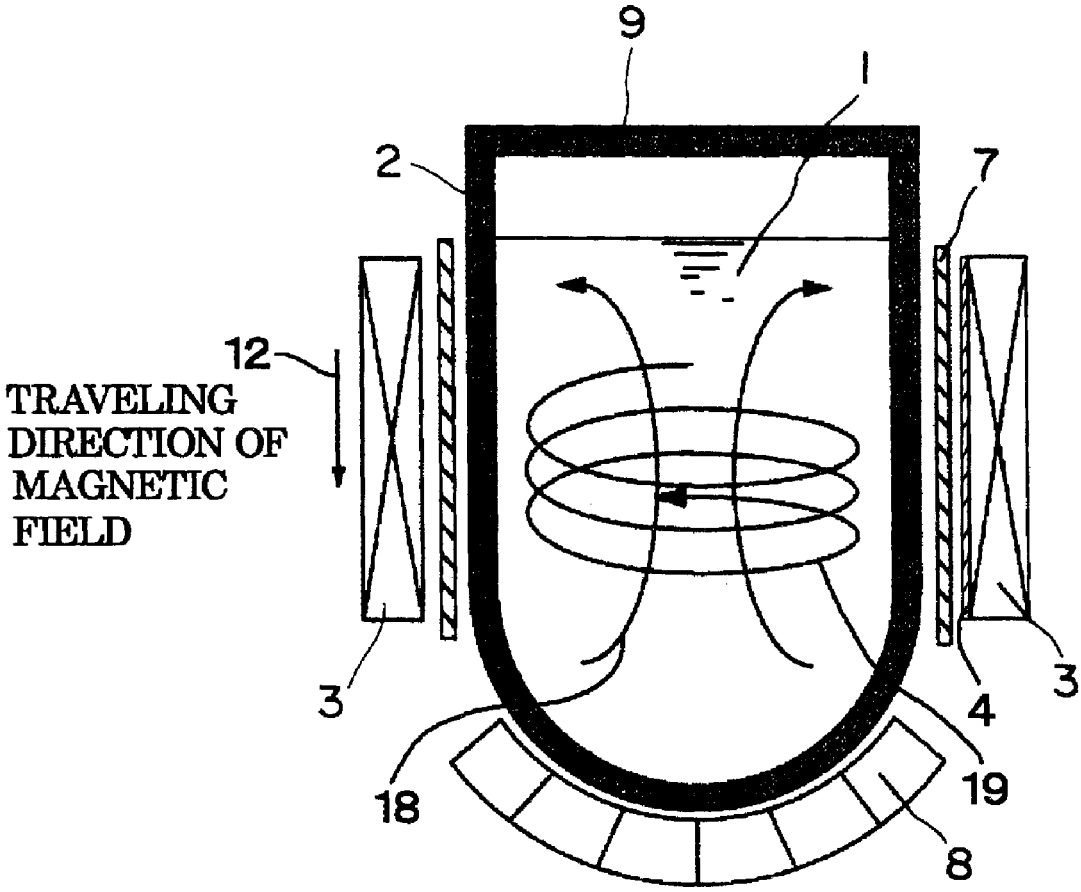
FIG. 1 is an elevational cross sectional view showing one embodiment of an electromagnetic stirring apparatus in accordance with the present invention.

1 Molten metal (electroconductive material in a molten state)
2 Vessel
3 Axially traveling magnetic field generating coil
4 Magnetic plate
10 Area/portion into which magnetic field enters
11 Area/portion into which magnetic field does not enter

BEST MODE FOR CARRYING OUT THE INVENTION

A configuration of the present invention will be described in detail in accordance with embodiments shown in the drawings.

An electromagnetic stirring apparatus in accordance with the invention includes a vessel for containing an electroconductive material in a molten state an axially traveling magnetic field generating coil for generating magnetic line of force in the vessel axis direction towards the electroconductive material in a molten state contained in the vessel from the outside of the vessel; and strip-shaped magnetic plates disposed between the coils and the vessel.

An axially traveling magnetic field is formed in the vessel by using the axially traveling magnetic field generating coil. Thereby, in the vicinity of a circumferential wall of the vessel, an axial electromagnetic force is formed by electromagnetic induction between a current flowing through the electroconductive material in a molten state, such as molten metal, thereby imparting axial motion to the molten metal in the vicinity of the circumferential wall. Concurrently, the magnetic field is prevented by the disposition of the magnetic plate from locally entering into the vessel. As a consequence, portions/areas into which the magnetic field does not enter and portions/areas into which the magnetic field enters are formed in the vicinity of the circumferential wall of the vessel. Thereby, a pressure gradient including a circumferential component resulting from the electromagnetic force is generated therebetween, whereby a stream different from the axial stream, that is, a stream including the circumferential component and along the pressure gradient, is generated. Then, streams formed by convolution of the axial motion and the rotary motion resulting from the pressure gradient imparted to the molten metal in the vicinity of the circumferential wall of the vessel are supplied, thereby to generate a convective flow in the vessel. In this manner, the molten metal is simultaneously stirred along the axial and circumferential directions.

The magnetic plate may either be disposed to diagonally extend across the coil or be disposed to extend along the axial direction of the coil.

Figure 2:
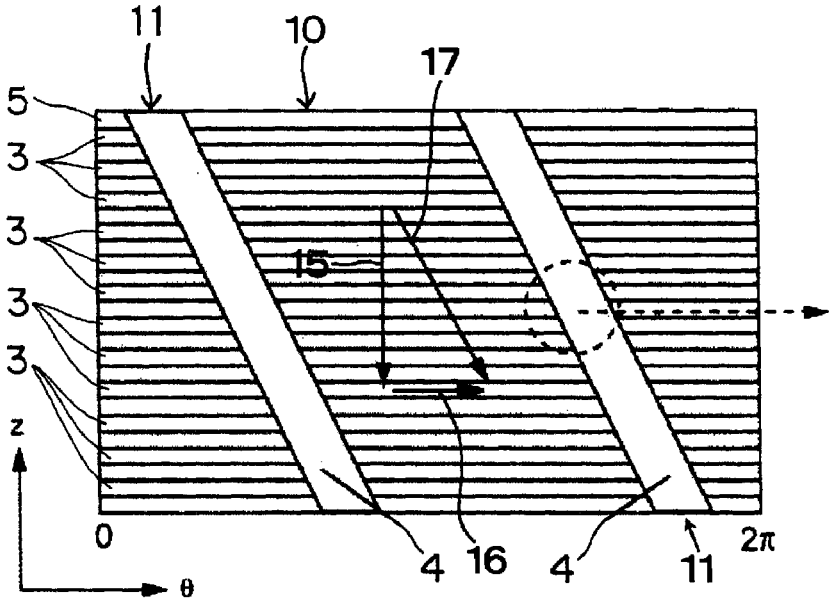
Figure 2:
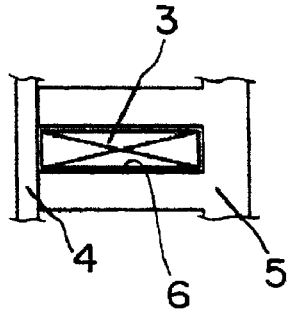
Figure 2:
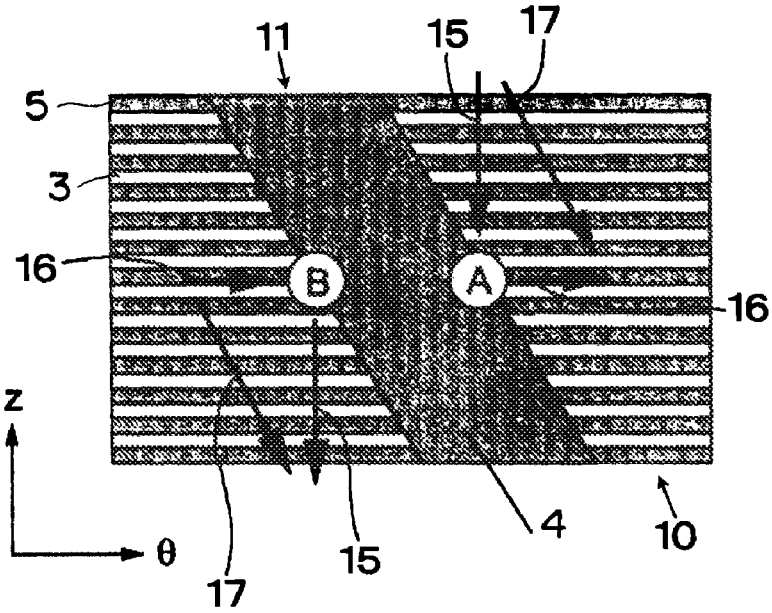
Figure 3:
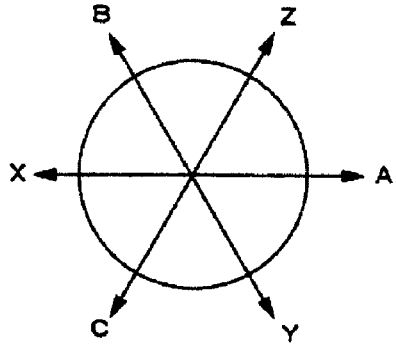
Figure 3:
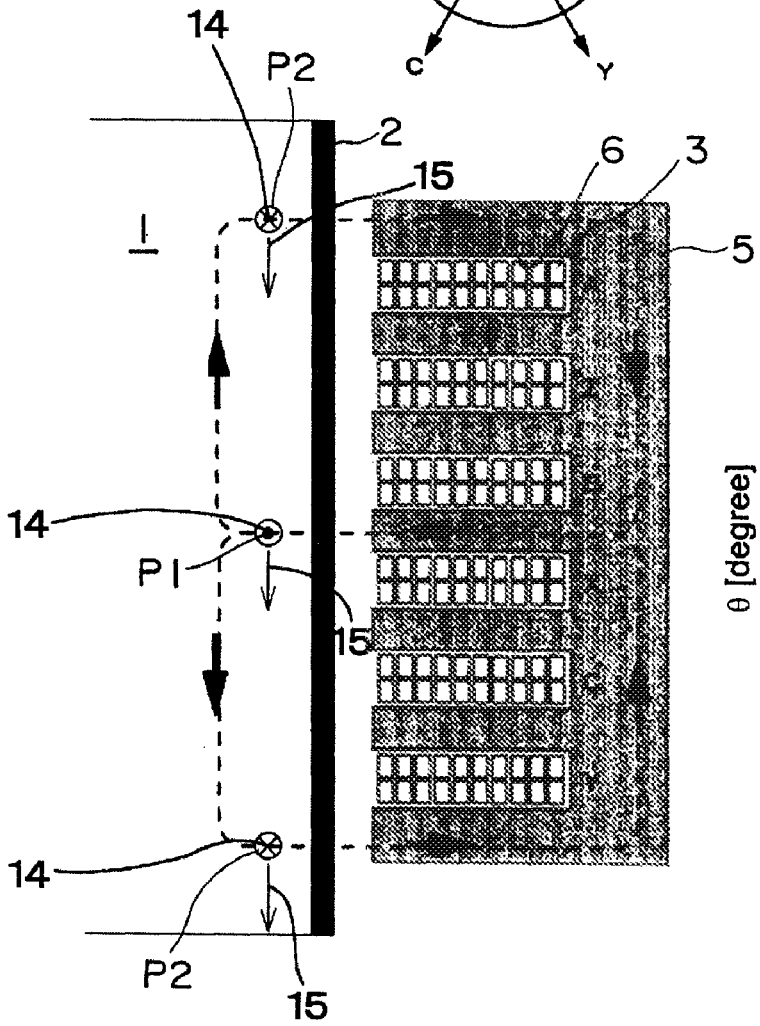
Figure 3:
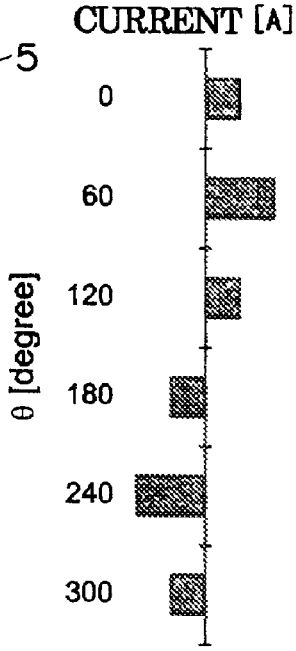

As an example, FIGS. 1 to 3 shows one embodiment of an electromagnetic stirring apparatus in accordance with the present invention. The electromagnetic stirring apparatus includes a vessel 2 for containing an electroconductive material in a molten state, such as metal (or, "molten metal", hereinafter) 1; an axially traveling magnetic field generating coils 3 (or, simply "magnetic field generating coils", hereinafter) for generating an axially traveling magnetic field exteriorly of the vessel 2; and strip-shaped magnetic plates 4 disposed between the magnetic field generating coils 3 and the vessel 2 and diagonally extending across the magnetic field generating coils 3. In the present embodiment, a travel direction 12 of the traveling magnetic field refers to an axially shifting direction from the upper portion to lower portion of the vessel 2.

The vessel 2 is formed from a material that has a melting point higher than a melting point of the molten metal 1 to be stirred and that has a high magnetic permeability to allow the permeation of magnetic line of force 13. The material is any one of, for example, a non-ferrous metal such as austenitic stainless steel, copper, or aluminum having a relative permeability of near 1 or so-called non-magnetic substance such as graphite or ceramic. The vessel 2 is formed into a shape having a sufficient volume and suitable for stirring the molten metal 1. For example, the vessel 2 is formed into a cylindrical shape, or more preferably, a cylindrical shape having a semi-spherical bottom portion for smoothly inversing the stream of the axially traveling molten metal 1 from a downflow stream to an upflow stream. Of course, the shape is not limited to the cylindrical shape. In the present embodiment, the vessel 2 is provided to be closable in its upper portion by an openable or closable lid 9, in which the molten metal 1 can be entered or drawn out by opening the lid 9. However, the configuration may include a supply or drainage facility provided to the vessel bottom that enables supply or drainage of the molten metal 1 depending on a material to be stirred.

In an exterior portion of the bottom portion of the vessel 2, there is disposed a heater 8, such as an induction heating coil, for maintaining the molten state of the molten metal 1 contained in the vessel 2. The heater 8 is not limited to the specific induction heating coil, but, preferably, the heater 8 employs induction heating in order to heat the to-be-stirred material, that is, the molten metal 1, in the vessel 2 without heating the vessel 2 itself. Nevertheless, however, a permeation burner for directly permeating heat into the molten metal 1, an electrical heater, or the like can be employed, depending on a material to be stirred.

The magnetic field generating coils 3 are disposed outside of the vessel 2 via a thermal shield 7 being interposed. The thermal shield 7 is interposed between the vessel 2 and the magnetic field generating coils 3, and prevents the magnetic field generating coils 3 from being heated by solid radiation heat from an exterior wall surface of the vessel 2. Similar to the vessel 2, the thermal shield 7 is formed from a material allows the permeation of magnetic line of force. Examples of the material are a non-ferrous metal such as austenitic stainless steel, copper, or aluminum having a relative permeability of near 1 or so-called nonmagnetic substance such as graphite or ceramic. The thermal shield 7 is formed into a cylinder shape in such manner as to cover the vessel 2.

The magnetic field generating coils 3 are disposed outside of the vessel 2 in such a manner as to cover the molten metal 1, which is contained in the vessel 2, and supplies an axially traveling magnetic field 12 to the molten metal 1 inside of the vessel 2. In the present embodiment, the magnetic field generating coil 3 includes a cylindrical iron core 5. The iron core 5 has, on its inner circumferential surface side, annular grooves (slots) 6 each formed to open in the inward direction. The magnetic field generating coil 3 is wound, by necessity, about several to 20 turns. The intensity of the magnetic field is determined corresponding to a multiplication of the number of coil turns times the current value. For this reason, the number of coil turns is determined to satisfy a condition enabling a desired magnetic field intensity to be obtained. More specifically, the number of coil turns is determined to satisfy the condition of "(magnetic field intensity)=(number of coil turns)×(current)". The current to be applied to the respective magnetic field generating coil 3 is obtained from "(electric current)=(voltage)/(impedance)".

A plurality of slots of the iron cores 5 are disposed concentric along the axial direction of the iron core 5 at equal intervals. A coil formed by concentrically winding a coil wire is contained in the respective slot 6. That is, the axially traveling magnetic field generating coil 3 includes a plurality of coils concentrically disposed along the axial direction. The number of magnetic field generating coils 3 is not limited to a specific number, but is arbitrarily set corresponding to, for example, the type and volume of the molten metal 1 to be contained and stirred in the vessel 2 and a stirring mode and intensity.

FIGS. 2 and 3 show examples of magnetic field generating coils 3 having 20 turns being wound. In the magnetic field generating coil 3 shown in FIG. 2, there are disposed three types of A, B, and C coils for respectively flowing three-phase alternating currents having a 120-degree phase difference from one another and three types of X, Y, and Z coils respectively connected to the A, B, and C coils and wound in the opposite direction relative thereto. Thus, the respective coils corresponding to the phases of the three-phase alternating currents are thus represented by letters A, B, and C and the respective coils oppositely wound relative thereto are thus represented by letters X, Y, and Z. In this case, as shown in FIGS. 3(B) and 3(C) for example, there are respectively connected between A and X, between B and Y, and between C and Z, and the coils are disposed in order as "A→Z→B→X→C→Y→A→ . . . →Y" towards the axially lower side of the vessel to have mutually opposing positional relationships, in which the respective coil phase difference between each of the coils is set to an angle of 60 degrees. More specifically, as shown in FIGS. 3(B) and 3(C), when A is set to 0 degree, Z, B, X, C and Y are set to 60 degrees, 120 degrees, 180 degrees, 240 degrees, and 300 degrees, respectively. In summary, the magnetic field generating coil 3 of the present embodiment is configured to include the plurality of coils concentrically disposed along the axial direction. Further, the coil is the three-phase alternating current coil in which the forwardly wound coils and the oppositely wound coils are used, in which the 60-degree phase difference is provided between each of adjacent coils. Consequently, when the three-phase alternating current is supplied from a power supply (not shown) to the magnetic field generating coils 3, as shown by an arrow in FIG. 3(A) for example, there occur the magnetic line of force 13 that return to the iron core 5 through the vessel 2 and the thermal shield 7 after transmitting through the thermal shield 7 and the vessel 2 from the iron core 5 and reaches the molten metal 1. While the magnetic line of force 13 occurs in units of the respective coil, the traveling magnetic field 12 in the axially downward direction of the vessel is formed due to, for example, the phase difference between the adjacent coils, winding directions thereof, and variations in the current flowing to the respective coils.

Although not shown in the drawings, depending upon the case, the coils 3 are disposed in a circular case filled with coolant such as cooling oil, thereby to prevent overheating due to electrical conduction. The three-phase alternating current of an arbitrary frequency is conducted to the axially traveling magnetic field generating coils 3 from a three-phase alternating current commercial power supply by way of a frequency tunable inverter or the like.

The strip-shaped magnetic plates 4 to be disposed between the magnetic field generating coils 3 and the vessel 2 are each provided in such a manner as to diagonally extend across the magnetic field generating coils 3. The magnetic plates 4 of the present embodiment are each fixedly adhered or fixed to be in contact with edge portions of two sides of the slot 6 of the iron core 5, which slot is to contain the magnetic field generating coil 3. Two to four magnetic plates 4 are each disposed along the circumferential direction to the axially traveling magnetic field generating coils 3 at an angle in the range of from 30 to 60 degrees or preferably at an angle of about 45 degrees. Even when the angle is larger or smaller than the range of from 30 to 60 degrees, the circumferential pressure gradient for forming the spiral stream is reduced, so that inasmuch as the angle is about 45 degrees, a pressure gradient optimal for obtaining the spiral stream can be obtained. For the magnetic plate 4, it is preferable to use, similarly as for the iron core, any one of magnetic core materials having a high magnetic permeability, for example, soft magnetic materials including pure iron, silicon steel plate, an alloy such as permalloy, and oxide such as Mn—Zn ferrite, or sintered compact thereof.

According to the electromagnetic stirring apparatus 1 described above, when the three-phase alternating current is conducted to the three-phase alternating current coils or magnetic field generating coils 3, the magnetic line of force 13 passing through the yoke around the coils in accordance with the Ampere's rule is generated. The magnetic line of force 13 generated by the coils permeates through the vessel wall and enters into the molten metal 1, thereby to form a magnetic path. With a time variation in the three-phase alternating current, the magnetic field around the coil travels. In accordance with the traveling magnetic field 12, a current 14 is generated in the circumferential direction at all times in the molten metal in accordance with the Faraday's electromagnetic induction law. While the orientation of the current 14 all time varies in association with magnetic field fluctuation caused by the traveling magnetic field, an electromagnetic force 15 is all time in the same orientation, and hence is generated towards the vessel bottom. More specifically, with the downwardly traveling magnetic field 12 being formed, the current 14 circumferentially flowing is generated in the molten metal in the vicinity of the wall surface of the vessel 2, that is, in a position where the magnetic line of force permeates through the vessel. For example, in a position P1 of FIG. 3(A), a current in the direction from the reverse to obverse side of the drawing sheet is generated, while in a position P2 of FIG. 3(A), a current in the direction from the obverse to reverse side of the drawing sheet is generated. The downward electromagnetic force 15 is generated from the traveling magnetic field and the current generated in the molten metal 1 in accordance with the Fleming's law. Although the current generated in the conductive liquid 1 is reversed in the direction, also the winding directions of the A, B, and C coils 3 and X, Y, and Z coils 3 are reversed, so that the all-time downward electromagnetic force 15 is generated.

On the other hand, however, in a portion having the magnetic plate 4, although the magnetic line of force flows to the magnetic plate 4, the magnetic line of force does not enter into the molten metal in the vessel. More specifically, while in the portion not having the magnetic plate 4, the magnetic line of force enters into the molten metal 1 in the vessel 2, the magnetic line of force does not enter into the molten metal 1 in the portion having the magnetic plate 4.

For the reasons described above, in the molten metal 1, not only the axial electromagnetic force 15 being generated, but also the circumferential pressure difference is simultaneously generated. As such, diagonal thrust force resulted from combination of the axial electromagnetic force 15 and a circumferential pressure gradient 16 works on the molten metal 1, thereby causing the molten metal 1 to generate a stream 17 along a diagonal downward direction (towards the furnace bottom). The stream 17 is reversed in the direction on the furnace bottom to an upflow stream. The stream flows upward to the liquid surface in the center of the furnace, and in addition, is again reversed on the liquid surface towards the side of the furnace wall. Then, the stream flows as a downflow stream along the furnace wall surface and generates a convective flow that circulates. Although the convective flow has an axial movement 18 as a principal component, the movement 18 involves a circumferential rotary component 19, and therefore, the convective flow works as a stream for simultaneously performing axial and circumferential stirring.

Occurrence of the circumferential pressure gradient 16 associated with the disposition of the strip-shaped magnetic plates 4 will be described hereinafter with reference to an example. As shown in FIG. 2(C), balance between the electromagnetic force and pressure acting on the molten metal in the vicinities of edges A and B of the strip-shaped magnetic plate is now considered. Where the electromagnetic force is f and the pressure is p, they are related as represented by the following equation in the portion not having the magnetic plate 4:

$$\nabla^2 p - \nabla \cdot f = 0.$$

Where δp represents an increment in the pressure corresponding to a spatial variation in the electromagnetic force due to the influence of the magnetic plate 4, the increment is represented as $$\delta p = \nabla^2 p - \nabla \cdot f.$$

on the edge A, since the electromagnetic force disappears in the magnetic plate portion, $$\nabla \cdot f < 0.$$

Accordingly, $$\delta p > 0.$$

On the edge B, since the electromagnetic force, which is zero in the magnetic plate portion, appears, $$\nabla \cdot f > 0.$$

Accordingly, $$\delta p < 0.$$

Thus, the circumferential pressure gradient occurs due to increase or reduction in the pressure on the edge A, B of the magnetic plate 4, and is combined with the electromagnetic force 15, whereby the diagonal stream 17 is formed. Portions/areas 11 into which the magnetic field does not enter because of the disposition of the magnetic plates 4 are diagonally formed. Thereby, the circumferential pressure gradient 16 is formed between the portions/areas 11 and portions/areas 10 which are spaced apart from the magnetic plates 4 and into which the magnetic field enters. As a result, spiral streams formed by convolution of the axial motion 18 resulting from the axial electromagnetic force 15 and the rotary motion 19 resulting from the circumferential pressure gradient are generated in the molten metal 1 flowing in the vicinity of the circumferential wall of the vessel 2. The spiral stream causes the molten metal 1 in the vessel 2 to generate the convective flow, thereby to produce not only axial stirring effects but also circumferential stirring effects.

In the state where the streams formed by convolution of the axial motion and the rotary motion are generated in the molten metal 1, a downflow stream is generated in the molten metal 1 flowing in the vicinity of the circumferential wall of the vessel 2, and an upflow stream is generated in the molten metal 1 flowing in the central portion of the vessel 2. In addition, the liquid surface of the molten metal 1 is recessed by the rotary motion resulting from the circumferential pressure gradient in the central portion of the vessel 2. As a consequence, the liquid surface of the molten metal 1 is formed substantially uniform and maintained substantially flat along the radial direction of the vessel 2. As such, no case occurs in which the molten metal 1 overflows from the vessel 2 even when a high flow velocity motion is generated in the molten metal 1 by supplying a high current to the axially traveling magnetic field generating coils 3.

Further, in the apparatus in accordance with the present invention, a part of the axially traveling magnetic field generated by the axially traveling magnetic field generating coil 3 does not enter into the molten metal 1, and the circumferential pressure gradient is generated, thereby to obtain the rotary motion. For this reason, the magnetic field generation is utilized as the primary source for the axial motion causing resistance higher than the rotary motion of the molten metal 1, and the rotary motion obtained without loss of the axial motion can be convoluted into the axial motion. Consequently, intensive and uniform stirring can be caused in the molten metal 1.

Figure 4:
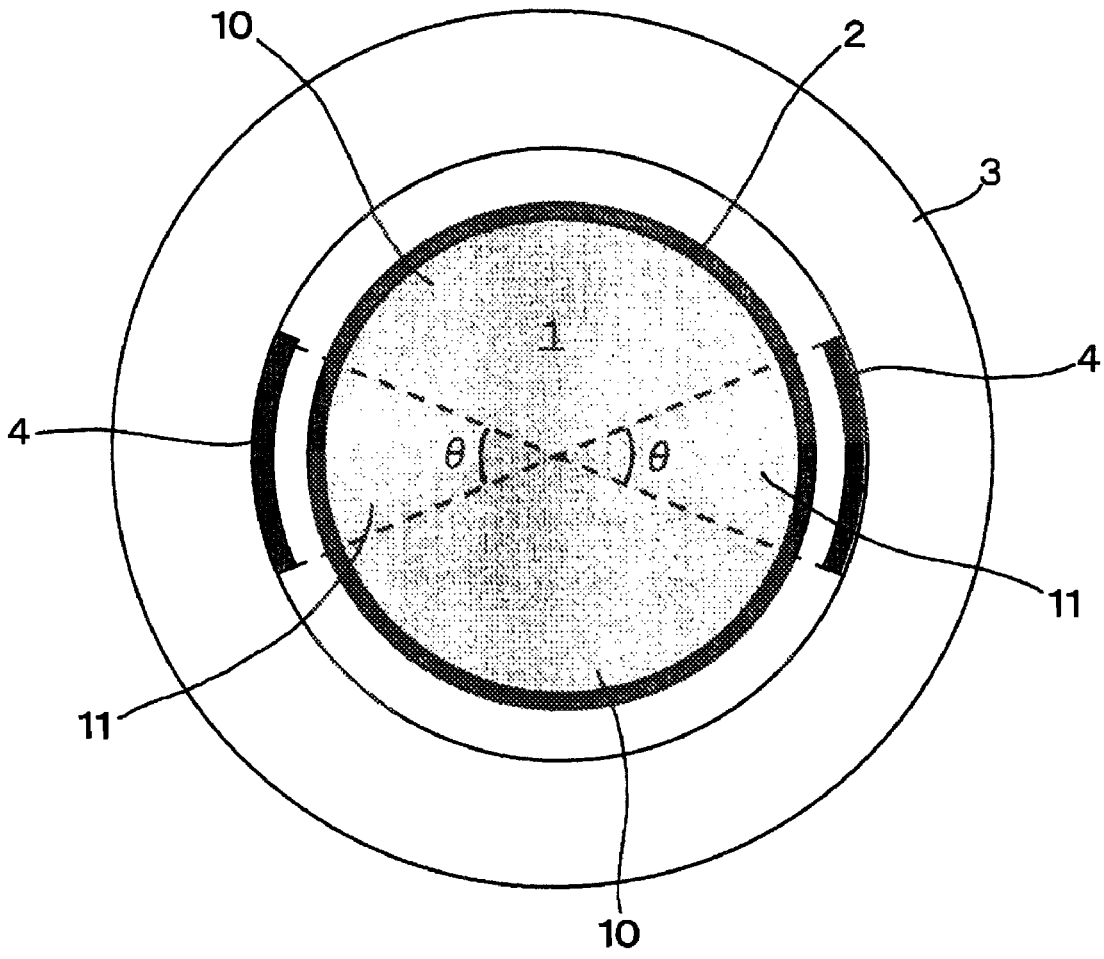
FIG. 4 is a transverse cross sectional view showing a general configuration of another embodiment of the electromagnetic stirring apparatus in accordance with the present invention.
Figure 5:
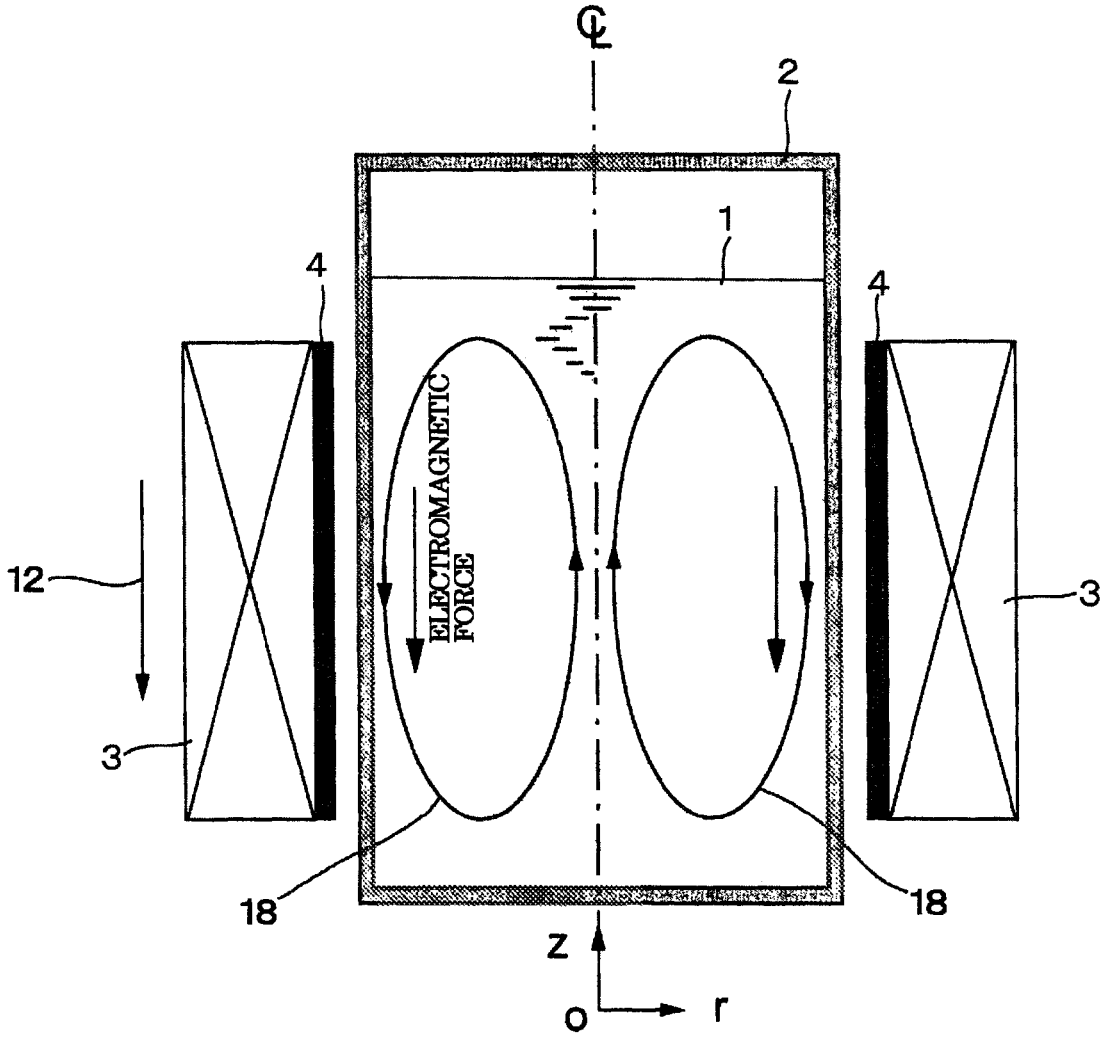
FIG. 5 is an elevational cross sectional view showing a general configuration of the electromagnetic stirring apparatus.
Figure 6:
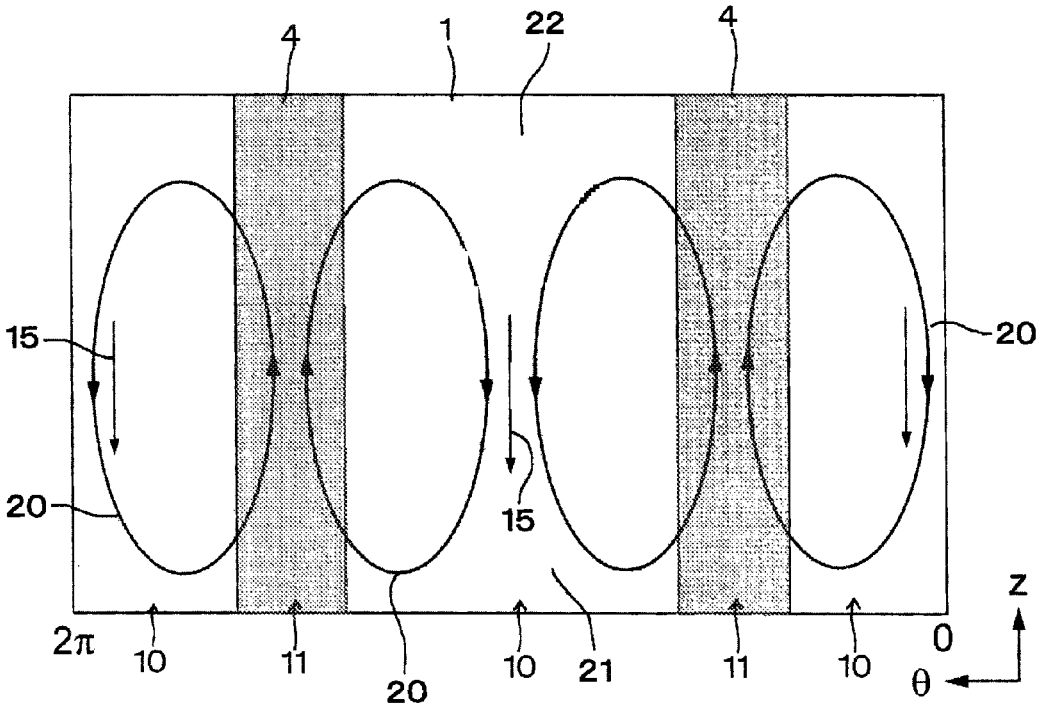
FIG. 6 is an explanatory view showing a flowing state of molten metal flowing in the vicinity of a circumferential wall of a vessel by way of the relationship with magnetic plates.

The following shows an example case of aluminum as a stirring object material, of which stirring is accomplished in accordance with the following specifications:

Capacity: 50 to 100 litters
Temperature: 700 to 900° C.
Three-phase alternating current coil voltage: 150 to 200 volts
Three-phase alternating current coil current: 100 to 150 amperes
Three-phase alternating current coil frequency: 10 to 20 hertz
Three-phase alternating current coil magnetic field (maximum value): 2 Tesla FIGS. 4 to 6 shows a second embodiment of the electromagnetic stirring apparatus the present invention. The electromagnetic stirring apparatus has a different configuration from the above-described or first embodiment in regard to the disposition of magnetic plates 4. However, other portions of the configuration are similar or identical to those of the first embodiment, so that descriptions thereof are omitted herefrom.

As shown in FIG. 4, the strip-shaped magnetic plates 4, which are to be disposed between the magnetic field generating coils 3 and the vessel 2, are disposed axially, that is, vertically, along the inner side of the magnetic field generating coils 3. The magnetic plates 4 of the present embodiment are each fixedly adhered or fixed to be in contact with edge portions of two sides of the slot of the iron core, which slot is to contain the magnetic field generating coil 3. Two magnetic plates 4 are disposed symmetrically at an angular interval of 180 degrees along the circumferential direction of the vessel 2. The width and thickness of the magnetic plate 4 and disposition interval between the magnetic plates 4 govern the sizes the area into which the magnetic field does not enter. For this reason, it is preferable that the dimensional factors be appropriately selected corresponding to conditions of the apparatus, such as required stirring conditions, magnitude of the magnetic field to be applied, and/or vessel size. For example, in a case where a difference between areas where the electromagnetic force is active and inactive is required to be conspicuous to generate large counter-flowing streams to thereby intensify the circumferential stirring, it is preferable that the width and thickness of the magnetic plate 4 be large correspondingly to the requirement. By way of example, in the embodiment shown in FIG. 4, the dimensional factors are set as appropriate values such that the width of the magnetic plate has an angle θ of 45 degrees with respect to the vessel center on the inner surface of the magnetic field generating coil 3, and the thickness of the plate is about 5 mm. However, of course, the dimensional factors are not limited such specific values. In addition, according to the present embodiment, two magnetic plates 4 are disposed at the angular interval 180°, and one or three or four magnetic plates may be provided.

According to the electromagnetic stirring apparatus 1 configured as described above, when magnetic line of force is generated around the coils by conduction of the three-phase alternating current to the magnetic field generating coils 3 (three-phase alternating current coils), the magnetic line permeates through the circumferential wall of the vessel 2 and enters into the molten metal 1, thereby forming magnetic paths in the portions/areas 10 not having the magnetic plates 4 and thus not influenced by the magnetic plates 4. However, in the portions/areas 11 where the magnetic plates 4 are not present and hence the influence of the magnetic plates 4 is not imposed, the magnetic line of force flows to the magnetic plate 4, and thus does not enter into the molten metal in the vessel. Consequently, in the vicinity of the circumferential wall of the vessel into which magnetic line of force 15 enters, an electromagnetic force 15 having the permanently same direction, or specifically, a downward traveling magnetic field in the present embodiment, is formed with the current directed by the electromagnetic induction to flow through the molten metal along the permanently circumferential direction. However, the electromagnetic force 15 is not generated in the portions/areas 11 having the magnetic plates 4. The forming of the magnetic line of force and the mechanism for generation of the electromagnetic force is already described in detail in the first embodiment, so that descriptions thereof are omitted herefrom.

The axial electromagnetic force 15 towards the molten metal 1 in the vicinity of the circumferential wall of the vessel 2 operates as follows. The axial electromagnetic force 15 operates to impart axial motion, or downward flow in the present embodiment, to the molten metal 1. The stream in the direction of the axially acting the electromagnetic force 15 causes a pressure difference between the upper and lower portions of the molten metal in the vessel. As such, as shown in FIG. 5, the stream of a majority of the molten metal in the vicinity of the vessel wall causes a convective flow 18 that flows downward in the vicinity of the vessel wall and that flows upward in the center of the vessel. Further, a downward axial stream is generated by the electromagnetic force 15 in a portion spaced apart from the magnetic plate 4, but the electromagnetic force is not generated in the areas 11 having the magnetic plates 4. Accordingly, a reverse axial stream flowing from a high-pressure bottom portion 22 to a low-pressure upper portion 22 is generated in accordance with a pressure difference acting on the molten metal, that is, in accordance with a pressure difference in the molten metal between upper and lower portions of the vessel. As a consequence, as shown in FIG. 6, a part of a downflow stream of the molten metal generated in the portion 10, which is spaced apart from the magnetic plate and into which the magnetic line of force is likely to enter flows into the portion of the magnetic plate 4 as a circumferential stream directed to the side of the magnetic plate 4, which is the portion 11 into which the magnetic line of force does not enter. Then, after having been changed to an upflow stream and further to a circumferential stream separating from the magnetic plate in the upper portion of the vessel 2, then the part of the downflow stream again generates a convective flow 20 that includes a circumferential component along the circumferential wall of the vessel and that is changed to a downflow stream by the electromagnetic force.

Thus, in the molten metal 1, there are generated the convective flow 18 (see FIG. 5) directed downward to the vessel center along the circumferential wall of the vessel 2 and the convective flow 20 (see FIG. 6) involving movement to the circumferential direction along the vessel circumferential wall. Thereby, the circumferential stirring is performed in addition to the vertical stirring.

While the respective embodiments described above are the preferred examples of the present invention, the invention is not limited thereto, and can be carried out by being modified or altered in various ways without departing from the spirit and scope of the invention. For example, while the embodiment has been described with reference to the case contemplated such that the shifting direction of the magnetic field and the direction of the electromagnetic force are the downward direction, the shifting direction of the magnetic field can be set to the upward direction depending on the case. Regardless of the shifting direction of the magnetic field, similar stirring effects can be obtained, so that the upward or downward direction of the electromagnetic force is appropriately selected corresponding to required conditions. Further, according to the embodiment, while the magnetic plates 4 are mounted to the inner surface of the axially traveling magnetic field generating coils 3, they may be directly mounted to the outer circumferential surface of the vessel 2 or may be disposed in a space between the vessel 2 and the magnetic field generating coils 3. Further, the embodiment has been described with reference to the example using the bottomed vessel 2 used for stirring a material, such as aluminum molten metal 1. However, the present invention is not limited the specific one, and of course it can be applied to vessels of the type permitting metal to pass therethrough.

Further, according to the embodiment, the axially traveling magnetic field is formed by using the three-phase alternating current coils that generate the spatial distribution of smooth magnetic fields. However, the present invention can be carried out by two-phase coils inasmuch as they are alternating current magnetic field/alternating current coils.

Moreover, the embodiment has been described exemplifying the metal as an electroconductive material in a molten state for stirring. However, the material is not limited to such a specific metal, and electroconductive plastic materials and electroconductive ceramic materials can be stirred.

The invention claimed is:

1. An electromagnetic stirring apparatus, comprising:

a vessel for containing an electroconductive material in a molten state;

an axially traveling magnetic field generating coil for generating magnetic line of force in an axial direction of the vessel towards the electroconductive material in a molten state contained in the vessel from an outside of the vessel; and strip-shaped magnetic plates disposed along a circumferential direction of the vessel and at spaces between the coil and the vessel a plurality of strip-shaped magnetic plates disposed between the coil and the vessel, wherein a plurality of the strip-shaped magnetic plates are disposed along the circumferential direction of the vessel with a space between each magnetic plate; and whereas said magnetic plates provide portions in the vessel in which an alternating current magnetic field tends to pass and portions in the vessel in which the alternating current magnetic field cannot pass easily are formed alternately along the circumferential direction of the vessel.

2. The electromagnetic stirring apparatus according to claim 1, wherein each magnetic plate is disposed to diagonally extend across the coil.

3. The electromagnetic stirring apparatus according to claim 1, wherein each magnetic plate is disposed in an axial direction of the coil.

4. The electromagnetic stirring apparatus according to claim 1, wherein the axially traveling magnetic field generating coil is an annular coil disposed concentrically along the axial direction.

5. The electromagnetic stirring apparatus according to claim 4, wherein the coil is a three-phase alternating current coil using forwardly wound coils and oppositely wound coils, a 60-degree phase difference being provided between adjacent coils each.

6. The electromagnetic stirring apparatus according to claim 1, wherein each magnetic plate is in contact with a core of the axially traveling magnetic field generating coil.

7. The electromagnetic stirring apparatus according to claim 1, wherein the axially traveling magnetic field generating coil is disposed to cover the electroconductive material in a molten state contained in the vessel, along an outer circumferential surface of the vessel.

* * * * *